United States Patent [19]

Baram

[11] Patent Number: 4,513,861

[45] Date of Patent: Apr. 30, 1985

[54] CARTRIDGE FOR CHEMICALS

[76] Inventor: Martin Baram, 13 Svanholmvej, DK-2660 Brøndby-Strand, Denmark

[21] Appl. No.: 435,107

[22] Filed: Oct. 18, 1982

[30] Foreign Application Priority Data

Oct. 19, 1981 [DK] Denmark ..... 4600/81

[51] Int. Cl.[3] ..... B65D 25/08

[52] U.S. Cl. ..... 206/219; 206/221; 215/DIG. 8

[58] Field of Search ..... 206/219, 221; 215/DIG. 8; 222/145, 30

[56] References Cited

U.S. PATENT DOCUMENTS

| | | | |
|---|---|---|---|
| 3,318,484 | 5/1967 | Modderno | 222/145 |
| 3,439,823 | 4/1969 | Morane | 206/221 |
| 3,458,076 | 7/1969 | Babcock | 206/221 |
| 4,024,952 | 5/1977 | Leitz | 206/221 |
| 4,264,007 | 4/1981 | Hunt | 206/219 |
| 4,274,557 | 6/1981 | Shannon | 222/145 |
| 4,315,570 | 2/1982 | Silver et al. | 206/221 |
| 4,386,696 | 6/1983 | Goncalves | 206/221 |

FOREIGN PATENT DOCUMENTS

| | | | |
|---|---|---|---|
| 2753737 | 6/1979 | Fed. Rep. of Germany | 206/219 |
| 2476607 | 2/1980 | France | 206/219 |

*Primary Examiner*—Joseph Man-Fu Moy
*Assistant Examiner*—David T. Fidei
*Attorney, Agent, or Firm*—Hubbell, Cohen, Stiefel & Gross

[57] ABSTRACT

A cartridge comprising a threaded cap connected with one end of a first hollow cylinder the other end of which abuts a closing bottom piece, said parts being held together by a second outer cylinder with a top flange in conjunction with fastening and sealing organs inserted between the inner surface of the outer cylinder and the outer surfaces of the first cylinder and the bottom piece, said organs being dimensioned and shaped in such a manner that they permit the rigidly held opposing parts to be moved relative to each other when the cap is screwed down on a suitably threaded neck part until a predetermined gap between the flange and the top of the cap is closed.

12 Claims, 4 Drawing Figures

CARTRIDGE FOR CHEMICALS

Figure 1:
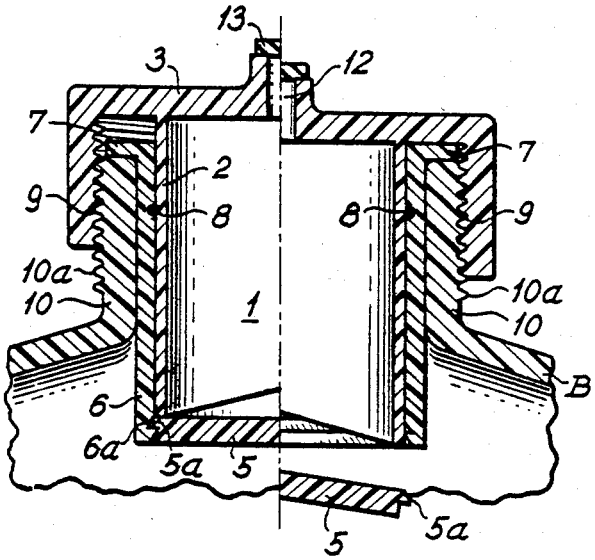

The invention relates to cartridges for packaging, storing and dispensing chemical concentrates and similar materials.

In modern householding and industry a considerable number of chemicals are used for cleaning, desinfecting, washing-up, textile treatment and other purposes which are sold in dilutions that can consist of up to 99% water packaged in relatively large throw-away containers.

This wasteful practice can be curtailed by selling chemical concentrates, which the customer can add to the desired quantity of water in a permanent dilution vessel.

It is known to sell such and other chemical concentrates in bottles, cans and the like. This applies especially to decidedly dangerous materials such as pesticides, herbicides and desinfectants for hospitals and veterinary premises. Other dangerous materials are employed in color photography laboratories and printing shops.

It is also known to provide such bottles with so called "safety-caps" in order to prevent children and other unsuspecting persons from gaining access to the dangerous contents. In spite of this such packaging has some serious disadvantages:

1. Even children very quickly learn to master the "tricks" necessary to overcome a safety-cap.

2. Regardless of the quality of the cap, eventually the cap has to be removed in order to decant the contents of the bottle. In the case of a fluid this entails that noxious fumes can emanate from the open flow of the fluid between the bottle and the receiving vessel. Furthermore, some of the fluid may be spilled and a last drop may run down the outside of the bottle. Additionally, the use of a funnel can be needed which adds to the problem of cleaning up to protect the environment and personnel. And in the case of powdered materials it is very difficult to control the scattering of dust particles in the atmosphere.

3. A further problem can be the correct dosage of chemicals. Using bottles which contain one specified unit may not prevent the user from lacking patience to empty it to the last drop, and using bottles containing several units to be used consecutively leaves residues of dangerous materials which may find their way into the environment.

It is the object of the present invention to provide a cartridge to replace bottles, cans and the like, which cannot be opened independently of a suitably protective shielding of the outflowing contents, eliminating evaporation, dripping or the use of a funnel, and which ensures the total evacuation of its contents.

It is known, mainly in the art of packaging and dispensing pharmaceutical products, to use so called "bicameral containers" which provide a protective shielding of a flow of materials between two containers. Such bicameral containers consist of a bottle, being the first chamber, and a so called "hollow-stopper", forming the second chamber in conjunction with a cutting tool and various auxilliary organs, differing from one embodiment to the other. This hollow-stopper invariably has the shape of a cup with a flanged top and a frangible bottom, this cup being inserted in the neck of the bottle until the flange abuts with the upper surface of the bottle neck. Into this cup is inserted the cutting tool in the shape of a hollow cylinder with a cutting edge aimed at the frangible bottom which form a chamber for the materials to be diluted in the bottle. Cup and cutting tool are fastened to the bottle neck by organs which ensure the airtightness, the protection of the cutter from inadvertent actuation, indeed the coherence of the various parts of that container.

The disadvantages of this container is:

1. That it does not have any independently functioning fastening and sealing organs which would prevent the container from falling apart.

2. The cup with frangible bottom can only be filled from the top whereafter the cylindrical cutting tool has to be inserted into it preventing the employment of seals at their interfaces in order to permit the entrapped air to escape, which in the case of a powder may cause unwanted dispersion of dust particles. This technical problem increases with the increased length of the cup and cutter, thus limiting the use of the hollow-stopper containers to very small dimensions.

3. Cutting up the cup's bottom means its destruction. This can be most undesirable in the case of containers made of more valuable and/or resistant materials than plastics, such as aluminum or stainless steel, and in all cases when the repeated use of the container is indicated.

Therefore, it is a further object of the present invention to provide a cartridge without the listed disadvantages.

Figure 3:
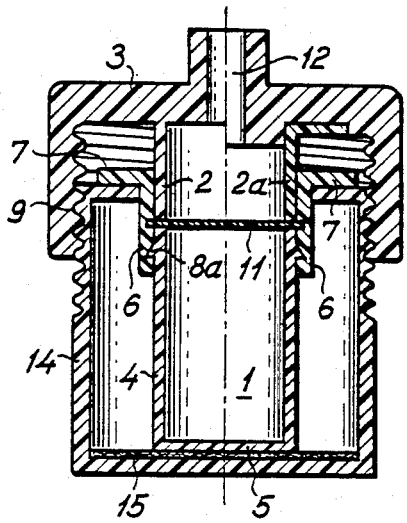
Figure 2:
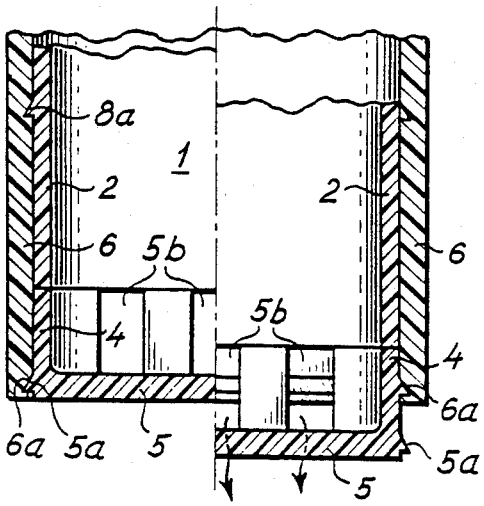
Figure 4:
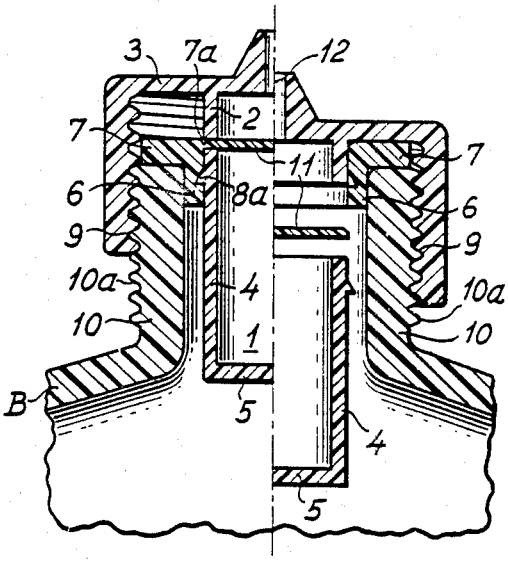

This is achieved by a cartridge as disclosed in the attached claims which are explained in detail in the following with reference to the accompanying drawings wherein:

FIG. 1 is a sectional view of the neck of a diluting container showing the cartridge in closed condition to the left of the middle line, and in open condition to the right of that line, FIG. 2 is a view of the broken away lower parts of a cartridge in a different embodiment showing the cartridge in closed condition to the left of the middle line, and in open condition to the right of that line, FIG. 3 is a view of another embodiment of a cartridge in conjunction with a protective casing, and FIG. 4 is a view of yet another embodiment of a cartridge mounted on a bottle, showing the cartridge in closed condition to the left of the middle line, and in open condition to the right of that line.

FIG. 1 shows a chamber 1 which is defined by a first hollow cylinder 2, a cap 3 and a closure bottom piece 5. Parts 2 and 5 are closely surrounded by a second cylinder 6 with a top flange 7. Between the two cylinders 2 and 6 a fastening and sealing organ is inserted, in this case in the shape of an O-ring 8. The bottom piece 5 has a ridge shaped edge **5*a* and the lower end of cylinder 6 is furnished with a corresponding groove 6*a* to fasten and seal said parts against each other. This sums up all the parts which constitute the cartridge in accordance with the invention forming an independent container unit with functions as will be explained further on. The cap 3 is furnished with an inner thread 9 which is fitted to be screwed onto a bottle neck's 10 outer thread 10*a*. The bottle is indicated with B. The cap can also be furnished with a channel 12 which is shown to be sealed by an integrated closure member 13. To the left of the middle line the cartridge is shown in the closed position in which there is a gap between flange 7 and the top of cap 3. Cylinder 2's lower end rests against closing piece 5. The cap 3 has been screwed only partly on the neck 10**.

At the right the cartridge is shown in the open position in which the cap 3 has been screwed down to the point where the gap is closed. The lower end of cylinder 2 has in consequence of this pushed the closing piece 5 out of its engagement with cylinder 6 and is seen dropping off. In this manner the entire contents of chamber 1 are forced to leave the cartridge which guarantees a correct dosage. In certain cases it is advisable to break closure member 13 in order to give access to the influx of air through channel 12 thus enhancing the evacuation of liquids with a high viscosity. Channel 12 can also serve to lead a stream of a solvent into the opened cartridge which can serve to dissolve especially dry materials which otherwise would settle at the bottom of the receiving bottle B, and/or it can flush off residues of the chemicals from the walls of chamber 1 so that the cartridge is cleaned before it is removed from the bottle. It is also apparent that cylinder 2 and bottom 3 are not comparable with a cup with frangible bottom wall in that the cylinder 2 and bottom piece 3 are two separate units which are held together by special fastening and sealing organs permitting the opening of chamber 1 without damaging either of them. Furthermore, this characteristic permits the choice between various shapes of bottom pieces and flanged cylinders, and this again permits the choice between various filling systems and various dispensation systems of various materials in both liquid and dry form. All this can be seen in the following FIGS.

FIG. 2 shows a different bottom piece 5 in that it is furnished with a cylindrical part 4 which is fitted into cylinder 6 in a tight fit apart from being fastened and sealed by organs 5*a*,6*a*. The cylindrical part 4 is furnished with at least one slitted opening 5*b* which on the left is shown to be covered by cylinder 6 when the cartridge is closed. On the right side the bottom piece has been dislodged in the manner described afore but it does not drop off thanks to the friction between cylinders 4 and 6 and/or the engagement of a special ridge in groove 6*a*. In this position the openings 5*b* are at least partly exposed so that chamber 1 can be emptied as indicated by two arrows. In this configuration the fastening and sealing organs between the cylinders 2 and 6 are a ridge-and-groove 8*a*.

Common for the embodiments explained so far is that chamber 1 is filled upside down through the open bottom whereafter either part 5 or part 4,5 is pressed into the sealing position. In the first case there is no problem with entrapped air at all, in the second case the entrapped air can escape through the slitted openings 5*b* until just before the sealing is established. This is especially convenient when finely ground powders are to be packaged in the cartridge.

FIG. 3 shows yet another bottom piece 4,5 with differently dimensioned cylinders 2 and 6. Here chamber 1 can be divided by a loose web 11 into a part defined by the bottom piece 4,5, and that by the cap 3 and cylinder 2. Bottom piece 4,5 is fastened and sealed to a short cylinder 6 in such a manner that it drops off entirely together with the breakable or dislodgeable web 11 when the cap 3 is screwed down. To the left cylinder 2 is integrated with cap 3 as before. To the right a cylinder 2*a* is a separate unit to permit the choice between caps 3 with different threads, thus saving the manufacture of a separate mould for each type of thread. The shown unit can also be used without the web 11 which has the function of a flat washer seal. This type of cartridge is especially indicated for dry or pasty materials which are supposed to dissolve gradually in a solvent. When dislodged the bottom piece 4,5 will drop to the bottom of the receiving vessel or float in it depending on the physical properties of the materials involved. In this case chamber 1 is filled standing up preferably with cylinder 6 already attached to it whereafter web 11 can be placed and finally cap 3 attached in any known manner. The same applies for both the left and right configuration. This cartridge is shown to be fastened inside a protective casing 14 which may be furnished with a shock absorbing and leakage preventing mat 15. The casing 14 has a threaded neck which fits the thread 9 of cap 3. The dimensions of the case 14 are such that the cartridge will abut mat 15 before any dislodgement of the web 11 and bottom piece 4,5 can occur. The duty of the casing is to protect the contents of the cartridge against unwanted exterior influences such as temperatures, vibrations, irradiations etc. and of course also to protect the environment against such influences coming from the inside of the cartridge in the case of highly dangerous materials such as poisons and cultures or microorganisms.

FIG. 4 shows a similar embodiment where lose web 11 is replaced by a web 11 integrated with flange 7 and furnished with a breakage line 7*a*. Here on the left side the bottom piece 4,5 is shown dropping off together with web 11 when dislodged by cylinder 2. The chamber 1 is filled standing up whereafter cylinder 6 with webbed flange 7,11 is pressed into a fastening and sealing position as shown by 8*a*. Also this embodiment can be combined with the casing 14,15 in order to give the entire assembly additional coherence and unity.

It will be appreciated that the embodiments just described may be modified without departing from the basic principles of the invention In particular can the various features be interchanged and the number and character of the fastening and sealing organs be determined in accordance with specific needs. The cartridge can be made of any suitable materials and various parts can be made of different materials.

What I claim is:

1. A cartridge for packaging, storing and dispensing chemical concentrates and similar materials, said cartridge being capable of submersion in any suitably dimensioned recipient container (B) by being inserted in a threaded neck (10,10*a*) thereof, said cartridge comprising a first cylindrical wall (6) with an outwardly extending flange (7) at its upper end, comprising also in overlaying relation a second cylindrical wall (1) extending in a frictionally sliding fit inside said first cylindrical wall (6) and having an integrated top wall (3) at its upper end and being generally open at its lower end, comprising furthermore a bottom piece (5 or 4,5) extending in a frictionally sliding fit inside said first cylindrical wall (6) abutting against said open lower end of said second cylindrical wall (2), comprising in addition fastening and sealing organs (5*a*, 6*a*, 8, 8*a*) inserted between on the one hand the first cylindrical wall (6) and on the other hand the second cylindrical wall (2) and said bottom piece (5 or 4,5) respectively, said organs being shaped and dimensioned to lock and maintain in sealed connection said cylindrical walls and bottom piece and thus to form a chamber (1) for the materials, said organs (5*a*, 6*a*, 8, 8*a*) being also shaped and dimensioned to permit a forced coaxial, downwardly oriented movement of said second cylindrical wall (2) and together with it of said bottom piece (5 or 4,5) relative to said first cylindrical wall (6) when the cartridge is inserted in said threaded neck (10, 10*a*) of said recipient container (B) and almost totally submerged therein with said flange (7) abutting against the upper rim of said neck (10, 10*a*) and when a fittingly threaded cap (H) belonging to said recipient container (B) is screwed onto said neck (10, 10*a*) pressing against said top wall (3) and thus said second cylindrical wall (2) together with said bottom piece (5, or 4,5) downwardly to create an opening at the lower end of said first cylindrical wall (6) for the discharge of the materials.

2. A cartridge as in claim 1, wherein said bottom piece has the general shape of a disc (5) furnished with said fastening and sealing organs (5*a*, 6*a*) adjacent to its outer periphery, said bottom piece being shaped and dimensioned to be inserted into the lower opening of said first cylindrical wall (6) after said chamber (1) has been filled with the material, said disc (5) being fastened to said first cylindrical wall (6) in such a manner that it is forced out of contact with said first cylindrical wall (6) when pressure is exerted against said top wall (3) and thus said second cylindrical wall (2).

3. A cartridge as in claim 1, wherein said bottom piece has the general shape of a disc provided with an upwardly extending circular wall, said fastening and sealing organs being adjacent to the disc part, said circular wall being provided with fastening organs in frictional fit with the lower end of said first cylindrical wall after the forced coaxial movement of the second cylindrical wall is completed, thus exposing at least one opening in said circular wall for the discharge of the materials.

4. A cartridge as in claim 1, wherein said bottom piece has the general shape of a disc (5) provided with a cylindrical wall (4) partly protruding from the lower end of said first cylindrical wall (6), said disc cylindrical wall (4) being provided with fastening and sealing organs in frictional fit with said first cylindrical wall (6) and situated between the lower end of said first cylindrical wall (6) and near the upper end of said disc cylindrical wall (4), said fastening and sealing organs being shaped and dimensioned to permit the forced disengagement of the disc cylindrical wall (4) from the first cylindrical wall (6) when the forced coaxial movment of the second cylindrical wall (2) is completed.

5. A cartridge as in claim 1, wherein said cap (H) is integrated with said top wall (3) of said second cylindrical wall (2).

6. A cartridge as in claim 4 further comprising a web (11) inserted between the upper end of said disc cylindrical wall (4) and the lower end of the second cylindrical wall (2) to separate the space enclosed by said bottom piece (5,4) from the space enclosed by said second cylindrical wall (2) and said top wall (3), said web (11) being connected with said first cylindrical wall (6) to permit its removal from said first cylindrical wall (6) together with said disc cylindrical wall (4).

7. A cartridge as defined in claim 1, wherein said first cylinder is in one piece with the cap extending inside said second cylinder to a point short of the second cylinder's length, and wherein said bottom piece consists of a disc shaped plate furnished with sealing and fastening means around ist rim which are in airtight contact with corresponding fastening and sealing means inside the free end of the second cylinder.

8. A cartridge as defined in claim 1, wherein said first cylinder is in one piece with the cap extending a short distance inside said second cylinder, and wherein said bottom piece consists of a cylindrical part with integrated closure which at its upper end is fastened inside the second cylinder with mutually fastening and sealing devices in continuation of the first cylinder in such a manner that bottom piece will slide free of the second cylinder.

9. A cartridge as defined in claim 8, wherein a separating plate is positioned between the abutting ends of said first cylinder and the cylindrical part in such a manner that the separating plate also slides free of the second cylinder.

10. A cartridge as defined in claim 1, wherein said first cylinder is in one piece with the cap and abuts from above a web with a breakage line extending from the flange of the second cylinder, and wherein said bottom piece consists of a cylindrical part with integrated closure the upper end of which extending inside said second cylinder and abutting said flange web from below, said upper end of the cylindrical part being fastened to the second cylinder by mutually faning and sealing devices in such a manner that the broken away part of the web and the bottom piece will slide free of the second cylinder.

11. A cartridge as defined in claims, 8, 9 and 10, wherein said first cylinder is a separate part from the cap being at its upper end fixed firmly inside the cap preferably by having a flanged part held in a groove in the cap.

12. A cartridge as defined in claim 1, wherein said sealing and fastening organs consist of O-rings, integrated ridge-and-groove locks, flat washers, or combinations of such organs.

* * * * *